US005664942A

United States Patent [19]

Bayer

[11] Patent Number: 5,664,942

[45] Date of Patent: Sep. 9, 1997

[54] REGENERATIVE THERMAL OXIDIZER

[75] Inventor: Craig E. Bayer, Wellsville, N.Y.

[73] Assignee: ABB Air Preheater, Inc., Wellsville, N.Y.

[21] Appl. No.: 328,881

[22] Filed: Oct. 25, 1994

[51] Int. Cl.[6] ..... F23D 3/40

[52] U.S. Cl. ..... 431/7; 431/11; 432/180; 165/104.16

[58] Field of Search ..... 423/210, 245.3; 431/7, 11; 432/180; 110/188, 190; 165/4, 104.15, 104.16; 588/214; 422/175, 182

[56] References Cited

U.S. PATENT DOCUMENTS 3,870,474 3/1975 Houston ..... 23/277 C 4,478,808 10/1984 Matros et al. ..... 423/522

*Primary Examiner*—Deborah Jones
*Assistant Examiner*—Amy M. Harding
*Attorney, Agent, or Firm*—Chilton, Alix & Van Kirk

[57] ABSTRACT

A single bed thermal oxidizer for oxidizing a contaminate in a gas (air) stream has a plenum above the bed containing burners for gaseous fuel and means for injecting excess air. The burners are activated to initially heat the adjacent top bed portion. The burners are then turned off and a mixture of gaseous fuel and air is passed down into and through the bed which oxidizes the gaseous fuel and transfers the hot portion of the bed downward to preheat the central region of the bed. At that point, the gaseous fuel is terminated and the contaminated gas stream is introduced into the preheated bed for oxidation of the contaminate.

2 Claims, 1 Drawing Sheet

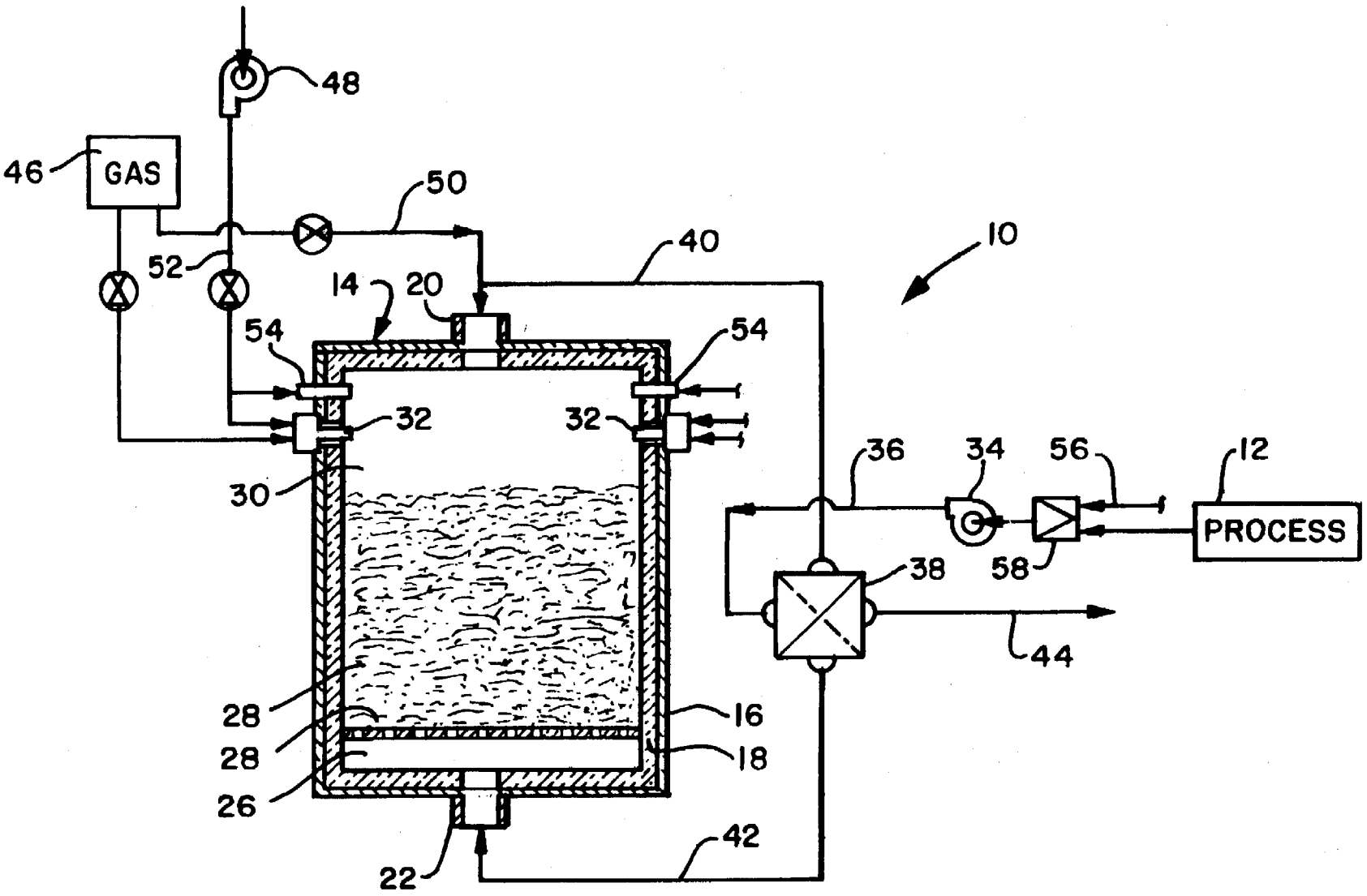
PROCESS
GAS
10
12
14
16
18
20
22
26
28
28
30
32
32
34
36
38
40
42
44
46
48
50
52
54
54
56
58

REGENERATIVE THERMAL OXIDIZER

BACKGROUND OF THE INVENTION

The present invention relates to apparatus for destroying contaminants such as volatile organic compounds in an air or other gas stream prior to release to the atmosphere.

More specifically, the invention relates to the incineration or oxidation of such contaminants in a reversing flow-type incinerator and to the system for preheating a bed of material having heat retention and heat exchanging properties.

Many manufacturing operations produce waste gases or exhaust air which include environmentally objectionable contaminants, generally combustible fumes such as solvents and other hydrocarbon substances, e.g., gasoline vapors, paint fumes and chlorinated hydrocarbons. The most common method of eliminating such combustible fumes prior to emitting the exhaust gases to the atmosphere is to incinerate the waste gas or exhaust air stream.

One method of incinerating the contaminants is to pass the waste or exhaust air stream through a fume incinerator prior to venting the waste gas or exhaust air stream into the atmosphere. An example of a fume incinerator for incinerating combustible fumes in an oxygen bearing process exhaust stream is disclosed in U.S. Pat. No. 4,444,735. In such a fume incinerator, the process gas stream is passed through a flame front established by burning a fossil fuel, typically natural gas or fuel oil, in a burner assembly disposed within the incinerator. In order to improve efficiency, it may be desirable to preheat the process exhaust stream prior to passing it through the flame front.

Another type of incinerator commonly used for incinerating contaminants in process exhaust streams is the multiple-bed, fossil fuel fired regenerative incinerator, such as, for example, the multiple-bed regenerative incinerators disclosed in U.S. Pat. No. 3,870,474. In the typical multiple-bed systems of this type, two or more regenerative beds of heat-accumulating and heat-transferring packing material are disposed about a central combustion chamber equipped with a fossil fuel fired burner. The process exhaust stream to be incinerated is passed through a first bed, then into the central combustion chamber for incineration in the flame produced by firing auxiliary fuel therein, and then discharged through a second bed. As the incinerated process exhaust stream passes through the second bed, it loses heat to the material making up the bed. After a predetermined interval, the direction of gas flow through the system is reversed such that the incoming process exhaust stream enters the system through the second bed, wherein the incoming process exhaust stream is preheated prior to entering the central combustion chamber, and discharges through the first bed. By periodically reversing the direction of gas flow, the incoming process exhaust stream is preheated by absorbing heat recovered from the previously incinerated process exhaust stream, thereby reducing fuel composition.

A somewhat more economical method of incinerating combustible contaminants, such as solvents and other hydrocarbon based substances, employs a single regenerative bed as disclosed in U.S. Pat. No. 4,741,690. In the process presented therein, the contaminated process exhaust stream is passed through a single heated bed of heat absorbent material having heat-accumulating and heat-exchanging properties, such as sand or stone, to raise the temperature of the contaminated process exhaust stream to the temperature at which combustion of the contaminants occurs, typically to a peak preheat temperature of about 900° C., so as to initiate oxidation of the contaminants to produce carbon-dioxide and water. Periodically, the direction of flow of the process exhaust stream through the bed is reversed. As the contaminants cornbust within the center of the bed, the temperature of the process exhaust stream raises. As the heated exhaust stream leaves the bed, it loses heat to the heat-accumulating material making up the bed and is cooled to a temperature about 20° C. to 50° C. above the temperature at which it entered the other side of the bed. By reversing the direction of the flow through the bed, the incoming contaminated process exhaust stream is preheated as it passes that portion of the bed which has just previously in time been traversed by the post-combustion, hot process exhaust stream, thereby raising the temperature of the incoming process exhaust stream to the point of combustion by the time the incoming process exhaust stream reaches the central portion of the bed.

In the prior art single regenerative bed incinerator, means are provided in the middle portion of the bed to heat the bed to the desired self-combustion or self-decontamination temperature during start-up and prior to the passage of any of the contaminated gases. This is usually done by means of an electric heater embedded in the middle of the bed of packing material. The problem associated with this system is that the use of electricity to preheat the packing material is expensive and requires a considerable period of time to heat up the mass of heat transfer material.

SUMMARY OF THE INVENTION

It is an object of the present invention to provide an improved system and process for a single bed regenerative thermal oxidizer to preheat the packing material in the bed. According to the invention, fossil fuel fired heating means are provided in the top end plenum of the oxidizer to initially heat the adjacent top bed portion. When this portion of the bed reaches the self-ignition temperature, the burners are turned off and an air flow containing natural gas is passed into the heated bed where it self ignites. As this process continues, the heat moves to the central region of the bed. At that point, the bed is properly preheated and ready for normal operation.

BRIEF DESCRIPTION OF THE DRAWING

The drawing is a schematic flow diagram showing a regenerative thermal oxidation system incorporating the present invention.

DESCRIPTION OF THE PREFERRED EMBODIMENT

The FIGURE shows a regenerative thermal oxidizer system 10 situated downstream from an industrial process generally represented by schematic block 12 which produces an air or other gas stream containing a contaminant. For example, a by-product of the process 12 may include a volatile organic compound, such as ethanol, hexane or butane. For purposes of this description, the stream will be referred to as an air stream but it could just as well be other gas streams.

The regenerative thermal oxidizer 14 comprises a closed and sealed steel casing 16 which is preferably lined with insulating material such as ceramic 18 to minimize heat loss through the casing walls. Ports 20 and 22 are located in the upper and lower ends respectively.

At the lower end of the casing, a perforated steel plate or the like 24 defines a lower plenum 26 and also supports the bed 28 of heat-accumulating and heat-transferring material.

This bed may be formed from quartz gravel, sand, ceramic pieces or any other suitable material. Located above the bed 28 is the upper plenum 30 which is equipped with one or more gas fired burners 32, which will be explained hereinafter.

The operation of the regenerative thermal oxidizer system depends upon the preheating of the central bed portion to a temperature which will cause oxidation of the contaminate. A conventional single bed regenerative thermal oxidizer would have an electric heater embedded horizontally in the middle of the bed material to heat up the center of the bed. Once this center layer is heated to the required temperature, the normal operation can commence. However, in the present invention, such an electric heater is not used.

In the present invention, one or more gas-fired burners 32 in the upper plenum 30 are fired from the gas source 46 and an air source which heats the upper portion of the bed 28. The burners are located in the upper end rather than the bottom end because the steel support plate 24 would not be able to withstand the high temperature. A considerable quantity of excess combustion air is employed, perhaps about 200%, so as to moderate the temperature to about 870° to 980° C. (1600°–1800° F.). The air source can be a combustion air blower 48 which introduces air directly through the burners 32 via line 52 and preferably introduces the large quantity of excess air through ports 54 adjacent to the burners. In addition, or as an alternative, the combustion air including the excess air can be supplied through port 20 by the main process fan 34 which draws ambient air from line 56 when damper 58 is switched. In any case, the burners 32 and the air injection ports are located such that the air is evenly heated.

The heated gases are forced down through the bed 28 so as to heat up this top portion of the bed. Once an adequate temperature in the range of 870° to 980° C. has been reached within the upper portion of the bed, the burners 32 are shut down. At this point, a mixture of air and natural gas is introduced into the upper plenum from line 50 and line 40. This gas/air mixture, which is also a lean mixture, is oxidized upon contacting the hot bed and the hot combustion products are forced down through the bed thereby forcing the heat to travel downwardly toward the center while the upper portion is cooled somewhat by the incoming gas/air mixture. When the hot portion of the bed has been pushed to the center of the bed, normal decontamination operations can begin.

The air stream containing the contaminant is forced from the process 12 by the blower or fan 34 through damper 58 and line 36 and into valve box 38. From valve box 38, the air flow can be directed either through line 40 or 42 to the regenerative thermal oxidizer 14. Likewise, the cleaned air stream from the thermal oxidizer 14 can be withdrawn through either line 40 or 42 and back through the valve box 38 to the discharge line 44. In other words, the valve box can be switched to reverse the flow through the regenerative thermal oxidizer 14. For example, the contaminated air would initially be fed to the top of the thermal oxidizer through line 40. As the air encounters the bed, it is heated until it reaches the central bed portion where the contaminate is oxidized. The heat of this oxidation is then transferred to the material in the bottom half of the; bed. The cleaned air is then discharged through line 42, valve box 38 and discharge line 44. After a period of time, the flow is reversed by switching valve box 38. The contaminated air then enters the bottom of the bed, encounters the heated bottom portion of the bed and is oxidized. The stored heat in the bed then moves back up toward the top half of the bed. This process can be continued indefinitely. Gas can be introduced via line 50 during the decontamination cycle if there is insufficient contaminate to maintain the level of oxidation and heat generation necessary.

I claim:

1. A method of operating a regenerative thermal oxidizer containing a bed of heat transfer material and an upper plenum above said heat transfer material to oxidize a contaminate in a gas stream comprising the steps of:

a. burning a gaseous fuel in said upper plenum together with excess air and flowing the products of combustion including the heated excess air down through said heat transfer material prior to the introduction of said gas stream containing said contaminate and thereby heating said heat transfer material adjacent said upper plenum to a temperature sufficient to oxidize a gaseous fuel;

b. extinguishing said burning gaseous fuel;

c. passing a mixture of gaseous fuel and excess air into said upper plenum and flowing said mixture down into said heated heat transfer material also prior to the introduction of said gas stream containing said contaminate and thereby oxidizing said mixture and transferring heat to said heat transfer material and preheating a central region of said bed of heat transfer material to a desired high temperature for oxidizing said contaminate;

d. discontinuing said mixture of gaseous fuel and excess air; and e. passing said gas stream containing said contaminate through said bed of heat transfer material containing said preheated central region to oxidize said contaminate.

2. A method as recited in claim 1, wherein said gaseous fuel is natural gas and said gas stream containing said contaminate is an air stream.

* * * * *